US005718340A

United States Patent [19]

Nagel

[11] Patent Number: 5,718,340

[45] Date of Patent: *Feb. 17, 1998

[54] MERCHANDISE RETENTION DEVICE FOR RETROFIT INSTALLATION ON DISPLAY HOOKS

[75] Inventor: Thomas O. Nagel, Blairstown, N.J.

[73] Assignee: Trion Industries, Inc., Wilkes-Barre, Pa.

[ * ] Notice: The term of this patent shall not extend beyond the expiration date of Pat. No. 5,542,633.

[21] Appl. No.: 587,223

[22] Filed: Jan. 16, 1996

Related U.S. Application Data

[63] Continuation-in-part of Ser. No. 511,356, Aug. 4, 1995, abandoned.

[51] Int. Cl.[6] ..... B42F 00/00

[52] U.S. Cl. ..... 211/57.1; 211/59.1

[58] Field of Search ..... 248/214, 309.2, 248/220.21, 303, 231.81, 74.2, 316.7; 211/57.1, 59.1

[56] References Cited

U.S. PATENT DOCUMENTS

| | | | |
|---|---|---|---|
| 4,474,300 | 10/1984 | Entis | 211/57.1 |
| 5,014,949 | 5/1991 | Niven | 211/57.1 |
| 5,375,725 | 12/1994 | Rosenthal | 211/59.1 |
| 5,423,436 | 6/1995 | Morrow | 211/59.1 |
| 5,485,929 | 1/1996 | Danon | 211/57.1 |
| 5,499,723 | 3/1996 | Morrow | 211/59.1 |
| 5,524,327 | 6/1996 | Mickel et al. | 248/316.7 |

*Primary Examiner*—Ramon O. Ramirez
*Assistant Examiner*—Willie Berry, Jr.
*Attorney, Agent, or Firm*—Schweitzer Cornman Grose & Bondell LLP

[57] ABSTRACT

A retention device for inhibiting removal of carded merchandise from a display hook, adapted for retrofit installation in existing loop hooks commonly used to display such merchandise. A flat plastic body, grooved along its side edges, can be inserted between and lockingly retained by the spaced apart wire elements of the U-shaped loop hook. An integral, resiliently depressable tongue extends upward and rearward from the flat body and prevents removal of the merchandise cards unless the tongue is depressed. The tongue carries a downwardly extending abutment tab to prevent merchandise cards from being pulled underneath the tongue. The grooved side edges preferably are formed by alternating, opposed half-grooves to facilitate production by high speed injection molding processes.

6 Claims, 2 Drawing Sheets

MERCHANDISE RETENTION DEVICE FOR RETROFIT INSTALLATION ON DISPLAY HOOKS

RELATED APPLICATIONS

This application is a continuation-in-part of my prior application Ser. No. 511,356 filed Aug. 4, 1995 now abandoned.

BACKGROUND AND SUMMARY OF THE INVENTION

One of the widespread merchandising techniques is to suspend carded merchandise from display hooks, typically mounted on apertured panel boards. The display hooks extend outward from the panel board several inches and mount multiple sets of carded merchandise, typically all of the same kind, on the same display hook.

When the carded merchandise has significant value, pilferage can be a considerable problem, because a shoplifter can easily slide a number of objects off of a single display hook and drop them into a shopping bag or the like. This can all be done in a swift motion, and the shoplifter frequently escapes without apprehension.

A number of devices have been proposed in the past to inhibit such wholesale shoplifting. In some cases, these proposals sufficiently inhibit the removal of merchandise as to interfere with legitimate sales. In other cases, the anti-pilferage arrangements can interfere with product loading.

One prior proposal for anti-pilferage of display merchandise is reflected by the Rosenthal U.S. Pat. No. 5,375,725. This patent discloses a one-piece, plastic display hook, which is formed with an upwardly and rearwardly projecting resilient tongue, near its forward end. The display hook is of generally flat, relatively rigid plastic material suitable to receive carded merchandise where the cards are formed with relatively wide, horizontal slots. The resilient tongue is arranged to deflect downwardly, when carded merchandise is loaded from front to rear onto the display hook. Once the merchandise card is behind the tongue, however, the tongue springs upwardly blocking removal of the merchandise from the display hook. Removal of the merchandise one item at a time is guite easily accomplished by depressing the resilient tongue with the thumb of one hand, while sliding the carded merchandise forwardly over the depressed tongue with the other hand. While not inhibiting legitimate, one at a time product removal, however, the device effectively prevents wholesale removal of multiple cards from the display hook in a single swooping motion.

While the device of the Rosenthal patent is functionally acceptable, it requires the complete replacement of product display hooks now existing in the marketplace, of which there are many millions. The cost of making such a complete replacement of merchandise hooks is inhibiting to many store owners and merchandise chains.

Accordingly, it is an objective of this invention to provide a anti-pilferage, merchandise retention device which is designed for retro-fit installation into existing display hook hardware. More specifically, the present invention provides a retrofit device, which may be installed in an existing "loop hook" display device, which instantly converts the otherwise conventional loop hook into an effective anti-pilferage device having a rearwardly directed resilient tongue which must be depressed in order to remove a product card from the hook.

Conventional loop hooks are formed with two outwardly extending, spaced-apart, parallel wire sections, which are joined at their outer end extremities by an integral, U-shaped wire section. Many millions of such loop hooks are currently in use throughout the world.

The device of the invention comprises a wide, flat body member, which is grooved along its opposite side edges in a manner to enable it to be snugly received between the spaced-apart, parallel wire sections of the loop hook. Once the body member is installed between the wire sections of the loop hook, it is firmly retained therein. The body member is formed with an upwardly extending, rearwardly directed resilient tongue to enable carded merchandise to pass over the body member in a rearward direction, for easy product loading onto the display hook, while effectively preventing product removal, unless the tongue is manually depressed.

In a preferred form of the invention, positioning means are provided for attachment to the outer extremity of the loop hook, in order to position the body member properly in the front-to-back direction on the hook. In a particularly preferred form of the invention, such positioning means includes a positioning member, which is separate from the body member but attached thereto by a flexible hinge. The positioning member is formed with a forwardly opening recess arranged to receive and grip the outer end portion of the loop hook and thereby secure the entire assembly in position. Because loop hooks quite typically are tilted upwardly at their outer end extremities, the flexible hinge connection between the body member of the device and the positioning member allows the latter to be disposed at an upwardly tilted angle relative to the former, as may be necessary to accommodate contours of the hook.

The device of the invention may be economically produced as a one-piece plastic molding, so that the device may be marketed at extremely low cost. To this end, the main body of the device is contoured along its opposite edges with a plurality of oppositely oriented partial grooves. A series of such partial grooves defines a positioning groove for partially receiving a wire section of the loop hook, so that the device is reliably secured in position between opposite side elements of the loop hook.

As a further feature of the invention, applicable as well to one-piece hook structure as to a retrofit device, the resiliently depressible tongue, which projects rearwardly to prevent uncontrolled product removal, is provided with a depending abutment tab, which extends from an outer end of the tongue toward the body of the device and substantially closes the space between the tongue and the adjacent surface of the main body of the device. Thus, when an attempt is made to remove the product card without depressing the tongue, the front face of the card will engage the abutment tab and be stopped. Otherwise, the card can become jammed underneath the upraised tongue, leading to damage and frequently tearing of the card. While the product itself is not damaged, when the card becomes torn or defaced, the merchandise contained therein frequently is unsalable. This form of loss is effectively prevented by the use of the depending abutment tab.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 1:
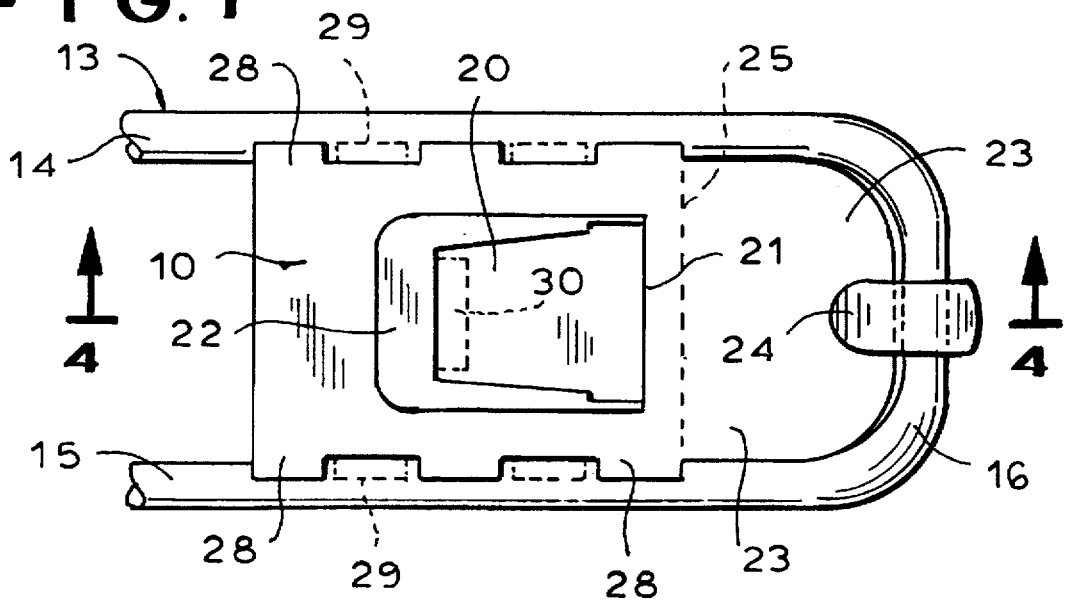
FIG. 1 is a top plan view of a merchandise retention device according to the invention.

Referring now to the drawing, the reference numeral 10 designates generally a body member of the new device, which is formed of plastic material and has generally flat, rectangular configuration. The thickness of the body 10, between its upper and lower surfaces 11, 12, is approximately equal to the diameter of the wire employed in the loop hook display device. Such a device is shown in a fragmentary way at 13 in FIG. 2, where the hook is shown to include first and second spaced-apart parallel wire elements 14, 15 integrally joined at their outer end by a U-shaped end portion 16.

The width of the body member 10, as reflected in FIG. 1, is approximately equal to the center-line-to-center-line distance between the wire side elements 14, 15 of the loop hook 13.

Figure 3:
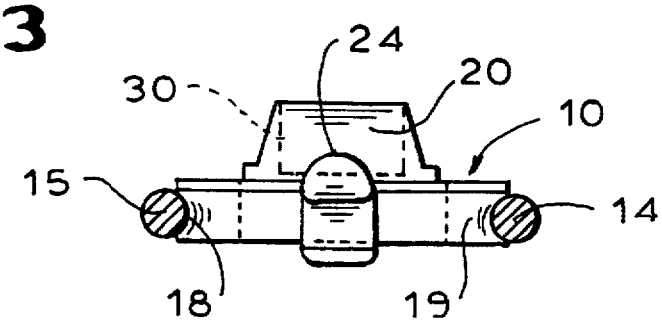
FIG. 3 is a front elevational view showing the device of the invention positioned between the side elements of a loop hook.

As shown in FIG. 3, the opposite side edges of the body member 10 are provided with formations defining semi-cylindrical grooves 18, 19, which are arranged to snugly receive the spaced-apart side elements 14, 15 of the loop hook. Thus, when the body member 10 is installed in position between the wire elements 14, 15, the body member is firmly retained in position therebetween and in general retains the wide, flat configuration of the loop hook, so as not to interfere with the passage of carded merchandise thereover.

In the device of the invention, the body member 10 is provided with an integral, upwardly projecting and rearwardly extending resilient tongue 20, which is anchored at its outer end 21. In the area of the resilient tongue 20, the body member is provided with a through opening 22, or a suitable recess, permitting the resilient tongue 20 to be depressed substantially into the cross sectional configuration of the body 10 itself.

At the forward end of the body member 10 is an integral, flexible hinge element 23, which joins with a positioning member 24. The positioning member 24 is molded integrally with the body 10 and the hinge 22, and is spaced forward of the front wall 25 of the body 10. In this respect, standard loop hooks often have upwardly tilted sections at their outer end extremity, and the forward spacing of the positioning member 24 enables that member to engage the front portion 16 of the loop hook, while the main body portion 10 is located on the straight portion of the loop hook. The flexible hinge portion 23 accommodates normal variation in the configuration of outer end portions of the hook.

Figure 2:
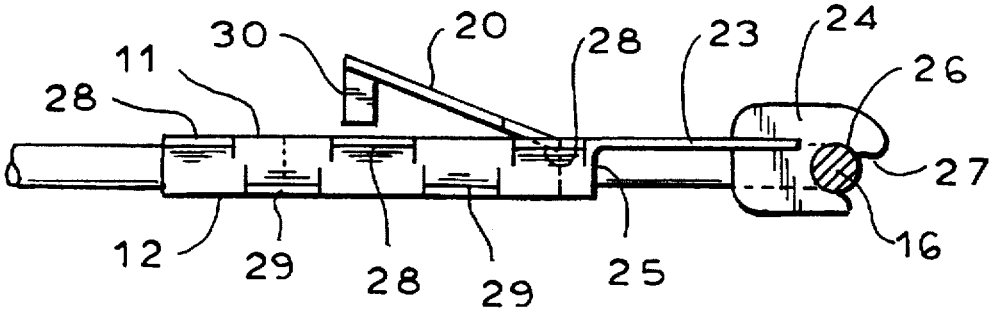
FIG. 2 is a side elevational view of the device of FIG. 1.

As shown particularly in FIG. 2, the positioning member 24 is formed with a forwardly opening partially circular recess 26 of a size to closely receive the outer end portion 16 of the loop hook. The recess is configured with a slightly restricted opening 27, allowing a slight snap-over action when the positioning member is applied to the hook portion 16, so that the device will remain in position, unless forcibly removed.

In the illustrated form of the invention, the lateral grooves 18, 19 defined at the edges of the device body 10 are formed by a succession of oppositely oriented half-groove elements 28, 29. With particular reference to FIG. 2, each of the upper half-groove sections define an upper half-groove 18, while each of the alternately spaced half-groove sections 29 define the lower half of the groove. A series of at least three such half-groove sections defines a full groove. In the illustrated invention, three upper half-groove sections 28 cooperate with two lower half-groove sections. This arrangement greatly facilitates high speed production molding of the device of plastic material, as it allows the half-groove sections to be produced using molds of simple construction and configuration.

In accordance with one embodiment of the invention, the resiliently depressible tongue 20 provided at its outer end with an integral, downwardly depending abutment tab 30 which projects toward and substantially fills the open space between the end of the tongue 20 and the upper surface 11 of the device body to prevent a merchandise card supported on the hook from inadvertently being pulled underneath the tongue 20.

Figure 4:
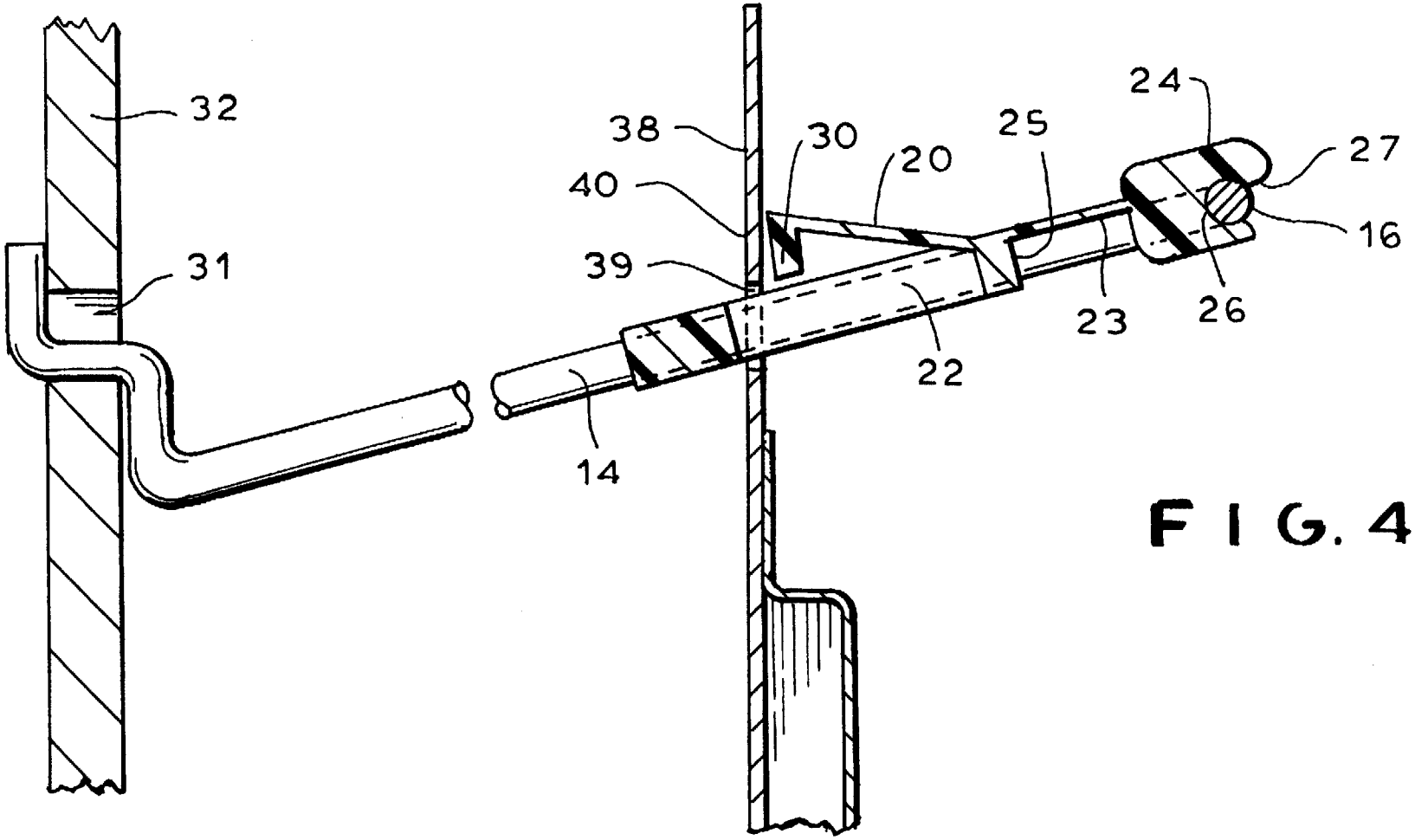
FIG. 4 is a cross sectional view as taken generally on line 4—4 of FIG. 1.

One common form of loop hook is shown in FIG. 4, in which the inner ends of the wire elements are configured as shown at 14, to provide L-shaped mounting lugs arranged to be inserted into a pair of adjacent openings 31 in a apertured panel board 32.

Where the loop hooks are sufficiently long, it may be possible to resiliently separate mid portions of the wire elements to accommodate installation of the merchandise retention device, without removal of the hook from the apertured panel board. Where this is not possible, or not convenient, the hook may be removed from the panel board, which allows the side elements to be easily separated as necessary for installation of the retention device.

As shown in FIG. 4, an item 38 of carded merchandise is typically provided with a wide flat opening 39 of a size and shape to be easily received over the outer end of a conventional wire loop hook. Such a conventional card is easily applied over loop hooks in which merchandise retention devices have been installed because, except for the positioning device 24 at the outer end, and the resilient tongue 20, the device of the invention does not significantly alter the cross sectional configuration of the wire loop hook. The positioning device 24 itself is easily accommodated within the conventional opening 39 in the merchandise card. However, the tongue 20 must be depressed in order to accomplish loading and removal of the merchandise. Loading of the merchandise can be easily accomplished by simply sliding the card rearwardly and allowing the card itself to depress the tongue as necessary. Removal, of course, requires manual depression of the tongue, as previously described.

As shown particularly in FIG. 4, the merchandise card 38 when moved forwardly on the hook without depression of the tongue 20, is blocked by the end of the tongue and also by the abutment tab 30. Without the abutment tab, the user can accidentally draw the card forward until portions 40 of the card, immediately above the slot 39, are forced underneath the tongue 20. This can damage or even tear the merchandise card. And while the customer eventually will become aware of the problem and depress the tongue 20 in order to remove the card, if the card is damaged the customer frequently will simply set it aside and remove a fresh item from the hook. The damaged card frequently becomes unsalable merchandise. With the depending abutment tab 30, however, this problem is effectively avoided.

As will be understood, the projecting length of the abutment tab 30 must be somewhat less than the vertical dimension of the card opening 39, so that the card can be extracted freely when the tongue 20 is depressed.

The device of the invention, while incorporating some of the beneficial functional features of the Rosenthal U.S. Pat. No. 5,375,725, has significant practical advantages for certain purposes because it enables retrofit installation of a merchandise retention device in the enormous numbers of existing loop hooks that are already installed throughout the world. The invention can be inexpensively manufactured with high production, injection molding techniques, using conventional structural plastic materials. Installation can be easily accomplished by unskilled store personnel, and the invention thus provides an advantageous, low cost alternative to complete replacement of existing hardware.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A merchandise retention device adapted for retrofit mounting on a wire loop hook, where the loop hook comprises elongated, spaced-apart, parallel side elements formed of wire and integrally joined at forward ends thereof by a generally U-shaped outer wire portion, which comprises (a) a generally flat body member having a length less than the length of the wire side elements of the loop hook, (b) said body member having spaced-apart side edges provided over at least a portion thereof with opposed, outwardly facing groove-forming means, (c) said body member having a width such that, when said body member is positioned between spaced-apart side elements of a loop hook, said side elements are partially received in said opposed groove-forming means, whereby said body member is lockingly held in said loop hook, (d) a merchandise retention tongue having one end anchored in said body member and projecting upwardly and rearwardly therefrom to a position normally blocking the movement of carded merchandise in a forward direction past said tongue, (e) said tongue being resiliently depressible toward said body member to enable carded merchandise to be placed on said loop hook and to be controllably removed therefrom, (f) said tongue having a free end positioned above said body member and defining a space between said free end and said body member, and (g) an abutment tab extending downwardly from the free end of said tongue and at least partially said body member to prevent the movement of a card portion between said tongue and said display element.

2. A merchandise retention device according to claim 1, wherein (a) said body member and said retention tongue are integrally molded of plastic material, (b) said body member is formed with a recess therein underlying said retention tongue and into which said tongue and abutment tab may be depressed to accommodate the passage of carded merchandise over said retention device.

3. A merchandise retention device according to claim 1, wherein (a) positioning means are provided for locking said body member against sliding movement along said wire side elements, said positioning means comprising (b) a positioning member flexibly joined with said body member at a position spaced from the forward end thereof, and (c) said positioning member being lockingly engageable with a forwardmost portion of said loop hook.

4. A merchandise retention device according to claim 3, wherein (a) said body member and said positioning member are joined by a flexible hinge element.

5. A merchandise retention device according to claim 4, wherein (a) said body member, flexible hinge element and said positioning member are integrally formed of molded plastic material.

6. A merchandise retention device adapted for retrofit mounting on a wire loop hook, where the loop hook comprises elongated, spaced-apart, parallel side elements formed of wire and integrally joined at forward ends thereof by a generally U-shaped outer wire portion, said device being of molded plastic construction and comprising (a) a generally flat body member having a length less than the length of the wire side elements of the loop hook, (b) said body member having spaced-apart side edges provided over at least a portion thereof with opposed, outwardly facing groove-forming means, (c) said body member having a width such that, when said body member is positioned between spaced-apart side elements of a loop hook, said side elements are partially received in said opposed groove-forming means, whereby said body member is lockingly held in said loop hook, (d) a merchandise retention tongue having one end anchored in said body member and projecting upwardly and rearwardly therefrom to a position normally blocking the movement of carded merchandise in a forward direction past said tongue, (e) said tongue being resiliently depressible toward said body member to enable carded merchandise to be placed on said loop hook and to be controllably removed therefrom, and (f) said groove-forming means comprising oppositely oriented alternating upper and lower half-groove elements positioned along the side edges of said body member, (g) there being at least two such half-groove elements facing in one direction and at least one such half-groove element facing in the opposite direction.

* * * * *

UNITED STATES PATENT AND TRADEMARK OFFICE

CERTIFICATE OF CORRECTION

PATENT NO. : 5,718,340

DATED : February 17, 1998

INVENTOR(S) : Nagel

It is certified that error appears in the above-identified patent and that said Letters Patent is hereby corrected as shown below:

On the title page:
Item [63], Please delete the word " abandoned ".

Signed and Sealed this

Twenty-eighth Day of April, 1998

Bruce Lehman

*Attest:*

BRUCE LEHMAN

*Commissioner of Patents and Trademarks*

*Attesting Officer*